US005831340A

United States Patent [19]

Kobayashi et al.

[11] Patent Number: 5,831,340

[45] Date of Patent: Nov. 3, 1998

[54] STARTER WITH HIGH VIBRATION RESISTANCE CONSTRUCTION

[75] Inventors: Yasuhiko Kobayashi, Chita-gun; Tsutomu Shiga, Nukata-gun; Nobuyuki Hayashi, Nogoya, all of Japan

[73] Assignee: Nippondenso Co., Ltd., Kariya, Japan

[21] Appl. No.: 653,055

[22] Filed: May 24, 1996

[30] Foreign Application Priority Data

May 25, 1995 [JP] Japan ..... 7-126070

[51] Int. Cl.[6] ..... F02N 11/00

[52] U.S. Cl. ..... 290/38 R; 290/46; 290/48

[58] Field of Search ..... 290/38 R, 38 A, 290/38 B, 38 C, 38 D, 38 E, 48, 46

[56] References Cited

U.S. PATENT DOCUMENTS

| | | | |
|---|---|---|---|
| 2,233,595 | 3/1941 | Elkin | 290/38 |
| 2,882,421 | 4/1959 | Mendenhall | 290/38 |
| 2,925,810 | 2/1960 | Mendenhall | 123/179 |
| 3,062,966 | 11/1962 | Merriam | 290/38 |
| 3,496,759 | 2/1970 | Buxton | 74/7 |
| 4,855,609 | 8/1989 | Eguchi et al. | 290/48 |
| 5,443,553 | 8/1995 | Shiga et al. | 74/7 R |
| 5,508,566 | 4/1996 | Nagao et al. | 290/38 R |
| 5,621,249 | 4/1997 | Shiga et al. | 290/38 R |

FOREIGN PATENT DOCUMENTS 63-168276 11/1988 Japan .

*Primary Examiner*—Steven L. Stephan
*Assistant Examiner*—Nicholas Ponomarenko
*Attorney, Agent, or Firm*—Cushman Darby & Cushman IP Group of Pillsbury Madison & Sutro LLP

[57] ABSTRACT

An output shaft is arranged coaxially with an armature shaft forwardly of a starter motor, and an electromagnetic switch is arranged at the rear of the starter motor. The output shaft and the armature shaft are independently supported by a first to fourth bearings. The first and second bearings are held on a housing and a center case. In the starter motor, a face type commutator is provided on the rear end of the armature, so that the axial length of the armature shaft is set short. The third and fourth bearings are held on a partition wall of a yoke of the starter motor and a holder, respectively.

12 Claims, 2 Drawing Sheets

STARTER WITH HIGH VIBRATION RESISTANCE CONSTRUCTION

BACKGROUND OF THE INVENTION

1. Field of the Invention

The present invention relates to a starter for starting an engine and, more particularly, to a starter having an improved vibration-resisting structure.

2. Related Art

Lately, demands have been made on starters for its miniaturization and reduction in weight to meet the denseness of an engine compartment and the fuel cost saving. As one countermeasure, high speed reduction ratio can be considered. With this, a high speed rotation type motor can be employed to miniaturize an armature of the motor. However, if a reduction ratio is increased to make the armature rotate at high speed, there arises a difficulty in improving vibration resistance. Particularly, in connection with the bearing construction of an armature shaft which rotates at high speed, it is necessary to enhance a rigidity by reducing a spacing between bearings or eliminating a deviation between bearings.

Further, the whole starter should be a compact construction such that vibrations are not imparted to the bearing to the utmost.

In a starter disclosed in Japanese Utility Model Laid-Open publication No. 63-168276, bearings for supporting opposite ends of an armature shaft are held directly by a frame (including a yoke) of the starter to eliminate a deviation between the bearings thereby enhancing the rigidity.

The starter disclosed in the aforementioned publication is rotatably supported on the inner peripheral surface of the armature shaft through the bearings with an output shaft inserted into the armature shaft. Accordingly, when the engine is driven or when in overrunning, vibrations caused by an engagement between a pinion and a ring gear are directly transmitted through the bearings from the output shaft. Therefore, the vibrations are also transmitted to the bearings which support the armature shaft rotating at high speed, impeding the stable rotation of the armature. As a result, there occurs inconveniences such as early wear of bearings, lowering of performance due to poor frictional contact between a commutator and a brush, and early wear of a brush.

SUMMARY OF THE INVENTION

The present invention has been accomplished in view of the aforementioned circumstances.

An object of the invention is to provide a starter which has a construction for a high vibration resistance thus enabling stable high speed rotation of an armature.

A further object of the present invention is to provide a starter construction wherein an output shaft and an armature rotating shaft are supported by first and second bearing members, and third and fourth bearing members, respectively, whereby when a pinion on the output shaft drives the engine or is overrun from the engine, vibrations received from the engine are resricted from being transmitted to the armature which rotates at high speed.

For this object, no unidirectional clutch is provided between the first and second bearing members, so that a spacing between the first and second bearing members can be made small. In addition, no heavy unidirectional clutch is provided between the first and second bearing members, so that a load applied to the output shaft can be suppressed to reduce a flexure of the output shaft and vibrations generated can be suppressed for a stable rotation.

With this construction, the output shaft itself hardly vibrates. The rotation of the armature is hardly affected by the rotation of the vibrating output shaft so that the armature can be rotated in a stable manner, thus preventing the early wear of the third and fourth bearing members.

A still another object of the present invention is to provide a starter construction wherein a first partition wall member integrally extends from one axial end side of a yoke of a starter motor to an armature rotational shaft side whereby the rigidity of the first partition wall member is enhanced and the armature rotational shaft can be rotated in a further stable manner.

A still another object of the present invention is to provide a starter construction wherein at the axial end of an armature core a face type commutator is provided substantially at right angles to the armature rotational shaft, and a second partition wall member constitutes a brush holding plate for slidably holding a brush on the face type commutator to thereby make a spacing between the third and fourth bearing members small to have a high rigid bearing construction for the armature rotational shaft.

A still another object of the present invention is to provide a starter construction wherein at least a part of the third bearing member is positioned where an armature coil is located at the radial inner peripheral side of a coil end projecting from an armature core to thereby make a spacing between the third and fourth bearing members smaller to have a high rigid bearing construction for the armature shaft.

Another object of the present invention is to provide a starter construction wherein an electromagnetic switch for controlling energization to a starter motor is disposed on the counter pinion side of the starter motor whereby the electromagnetic switch can be parted from the armature rotational shaft to eliminate the state where the armature rotational shaft and the electromagnetic switch tends to vibrate by resonance, thus enhancing the vibration proof for the whole starter. With this starter construction, the vibrations of a motor portion can be reduced, and the armature rotational shaft and the output shaft can be rotated stably.

BRIEF DESCRIPTION OF THE DRAWINGS

Other features and advantages of the present invention will be made more apparent in the following description when read in conjunction with the accompanying drawings, in which.

DETAILED DESCRIPTION OF THE PRESENTLY PREFERRED EMBODIMENT

A presently preferred exemplary embodiment of a starter according to the present invention will be described with reference to the drawings.

Figure 1:
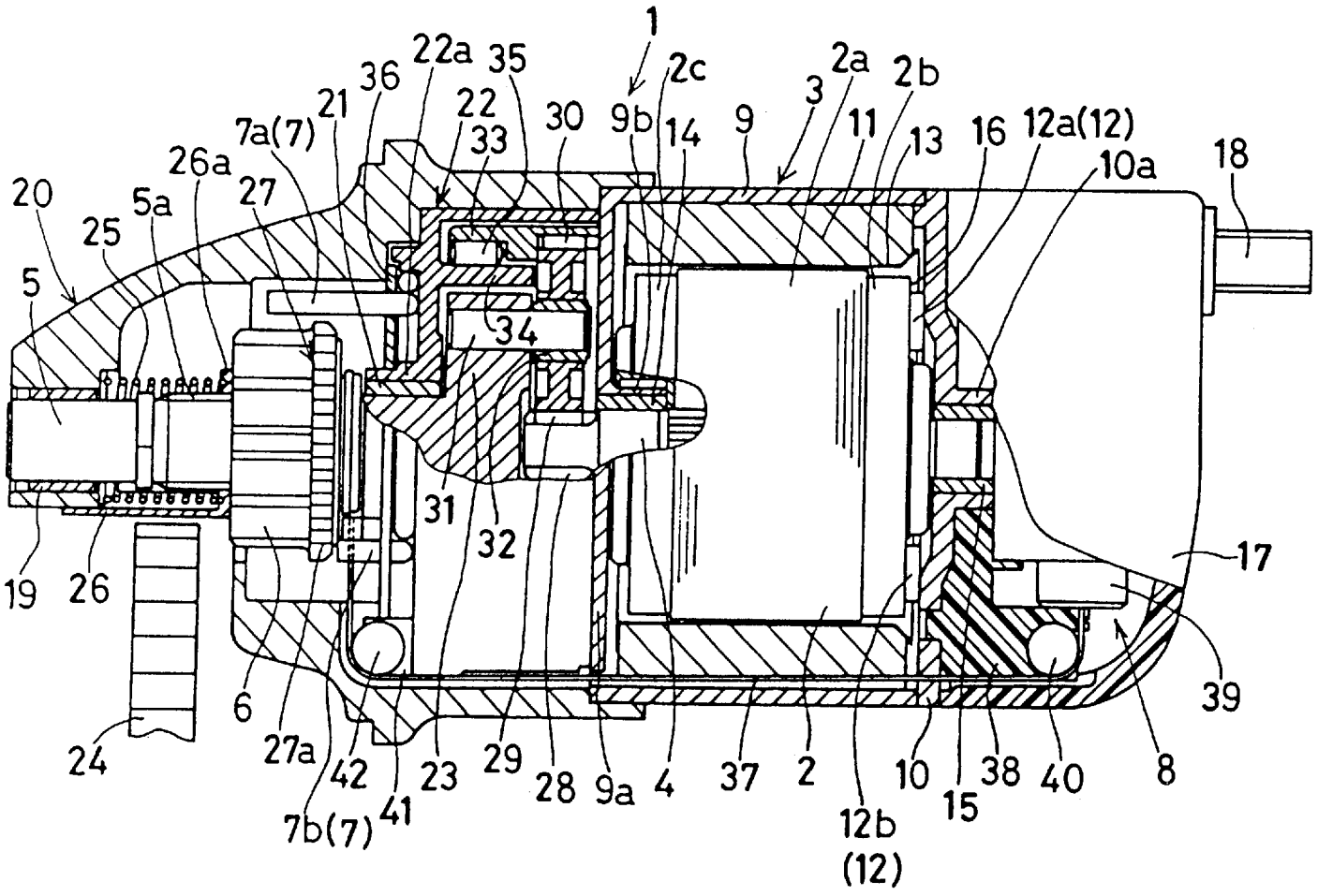
FIG. 1 is a sectional view of a starter according to an embodiment of the present invention.

In the present embodiment, a starter 1 is generally composed of a starter motor 3 for generating a rotating force when an armature 2 is energized, an output shaft 5 disposed coaxially with an armature shaft 4 at an axially forward location (left side in FIG. 1) of the armature 2, a pinion 6 fitted on the outer periphery of the output shaft 5, a rotating force transmission mechanism for transmitting a turning force of the starter motor 3 to the output shaft 5, a rotation regulating member 7 for regulating the rotation of the pinion 6 at rotation starting, an electromagnetic switch 8 arranged at the rear side (right side in FIG. 1) of the starter motor 3, and the like.

(Starter Motor 3)

The starter motor 3 is composed of a cylindrical yoke 9 made of a magnetic material, a holder 10 made of a magnetic material, fixed magnetic poles 11, an armature 2, brushes 12 and the like.

The yoke 9 has a cylindrical cup shape which is integrally formed, for example, by pressing (deep draw) with only a rear end side (a right end side in FIG. 1) opened. The front end side of the yoke 9 is folded in a radial direction, i.e., toward the armature shaft 4 to constitute a partition wall 9*a* (a first partition wall member) separating axially the armature 2 and the turning force transmission mechanism.

The holder 10 (a second partition wall member) constitutes a frame of the starter 1 along with the yoke 9, and is mounted on the rear end of the yoke 9 so as to close the rear end side of the yoke 9.

Each fixed magnetic pole 11 is formed by a permanent magnet, for example, which is secured to the inner peripheral surface of the yoke 9 by means of a fixed cylindrical sleeve 13 arranged on the inner periphery of the fixed magnetic pole 11. The fixed magnetic pole 11 may be formed of a field coil which generates a magnetic force by energization instead of a permanent magnet.

Figure 2:
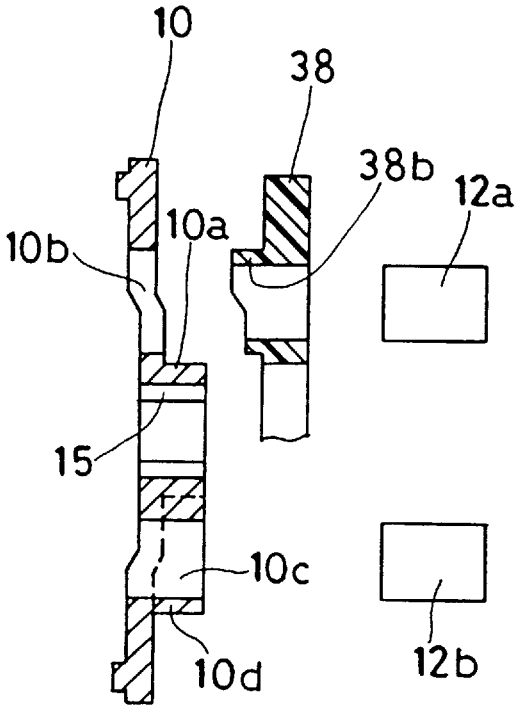
FIG. 2 is a sectional view showing a holder and a brush.

The armature 2 is disposed rotatably in the inner periphery of the fixed magnetic pole 11. The front axial end portion of the armature shaft 4 is supported in the cylindrical bearing portion 9*b* provided in the radially central portion of the partition wall 9*a* through a bearing 14 (a third bearing member), and the rear axial end portion of the armature shaft 4 is supported in a cylindrical bearing support portion 10*a* provided in the radially central portion of the holder 10 through a bearing 15 (a fourth bearing member). As shown in detail in FIG. 2, the holder 10 is formed in a generally disk shape and provided with, as through-holes, brush holder portions 10*b* and 10*c* for holding positive pole and negative pole brushes 12*a* and 12*b* axially movably therethrough. The positive pole side brush 12*a* is electrically insulated and held on the holder 10 in the state where a guide portion 38*b* provided on a pedestal 38 formed of an electrically insulating material of the electromagnetic switch 8 disposed on the holder 10 is inserted into the brush holder portion 10*b*. A guide portion 10*d* of the brush holder portion 10*c* provided on the holder 12 directly holds the negative pole brush 12*b* axially movably therein so that the brush 12*b* is electrically grounded.

Further, the armature 2 is composed of an armature core 2*a* and an armature coil 2*b* wound about the armature core 2*a*, and a face type commutator 16 formed by a radially inwardly extending portion of the armature coil is provided on the rear axial side end of the armature core 2*a*. The commutator 16 is provided so that the frictional contact surface with the brush 12 is substantially at right angles to the armature shaft 4.

The brush 12 comprises at least a set of the positive pole brush 12*a* and the negative pole brush 12*b*, which are respectively held by the holder 10 and normally biased onto the axial end face of the commutator 16 by means of respective biasing springs (not shown) from the axial rear end side. The spring for biasing the brush 12 is held by an electrically insulating end cover 17 mounted on the rear end side of the holder 10. To the end cover 17 is secured a terminal bolt 18 to which a battery cable (not shown) is connectable.

A part of the bearing 14 is received in the inner peripheral side of a coil end 2*c* of the armature coil 2*b* projecting toward the front end of the armature core 2*b*. That is, the bearing 14 protrudes axially into the armature core 2, so that a spacing or axial distance between the bearing 14 and the bearing 15 can be shortened.

(Output Shaft 5)

The output shaft 5 has its front axial end supported in a housing 20 through a bearing 19 (a first bearing member) and its rear axial end supported in a center case 22 (described later) received into the housing 20 through a bearing 21 (a second bearing member). The rear end of the output shaft 5 is projected radially outwardly to integrally provided a generally disk-shaped planet carrier 23 of a planetary gear reduction mechanism (rotation force transmission mechanism).

(Pinion 6)

The pinion 6 is formed in its inner peripheral surface with a pinion helical spline (not shown), which is fitted with a helical spline 5*a* formed on the outer periphery of the output shaft 5, so that the pinion 6 moves forward along the helical spline 5*a* to engage with a ring gear 24 of the engine flywheel for engine starting. This pinion 6 is always biased rearward of the output shaft 5 by means of a spring 25 disposed on the front end of the pinion 6. The spring 25 axially biases the pinion 6 through a ring portion 26*a* of a shutter 26 fitted radially outside the output shaft 5 frontwardly of the pinion 6. The shutter 26 is interlocked with the movement of the pinion 6 to open and close an opening which opens nera the ring gear 24.

At the rear end of the pinion 6 is integrally provided a rotation regulating plate 27 which is larger in outside diameter than the pinion 6. On the outer peripheral surface of the rotation regulating plate 27 are formed many (more than the number of outer teeth of the pinion 6) engaging grooves 27*a*, each extending in the axial direction, peripherally and equidistantly.

(Rotation Force Transmission Mechanism)

The rotation force transmission mechanism is composed of a planetary gear reduction mechanism and a unidirectional clutch, which is received in the center case 22 frontwardly of the partition wall 9*a* of the yoke 9.

The planetary gear reduction mechanism is a reduction unit for reducing the rotational speed of the armature 2 to increase an output torque of the starter motor 3 and comprises a sun gear 28 formed on the outer periphery at the axial front end of the armature shaft 4, three planetary gears 29 meshed with the sun gear 28 for revolving therearound, an internal gear 30 meshed with the respective planetary gears 29, and the planet carrier 23 described above.

The sun gear 28 rotates integrally with the armature shaft 4 to transmit the rotation of the armature shaft 4 to the three planetary gears 29. Each planetary gear 29 is rotatably supported through a bearing 32 on an axially extending pin 31 secured to the planet carrier 23 and revolves around the outer periphery of the sun gear 28 while being meshed with the sun gear 28 and the internal gear 30, whereby the revolving force thereof is transmitted to the planet carrier 23 to transmit the turning force to the output shaft 5.

The internal gear 30 is provided in the form of a cylindrical shape, and the outer peripheral surface thereof comes in frictional contact with the inner peripheral surface of the cylindrical wall of the center case 22 for rotation.

The unidirectional clutch rotatably supports the internal gear 30 of the planetary gear reduction mechanism only in one direction (in the rotating direction upon receipt of the rotation of the engine) and is composed of a clutch outer member 33, a clutch inner member 34, rollers 35 and biasing springs (not shown) for the rollers 35.

The clutch outer member 33 is provided integrally with the internal gear 30 on the front end side of the internal gear 30. The clutch outer member 33 is formed in the inner peripheral surface with a plurality of wedge-like cam chambers (not shown) extending generally in a peripheral direction for movably storing the rollers 35 and biasing springs.

The clutch inner member 34 is provided integrally with the center case 22 and axially extends in a predetermined radially spaced relation with the clutch outer member 33 at the inner peripheral side of the clutch outer member 33 to constitute a cylindrical shape.

The roller 35 is received in the cam chamber to lock the clutch outer member 33 and the clutch inner member 34 when transmitting the turning force of the starter motor 3 to the output shaft 5, thereby regulating the rotation of the clutch outer member 33. The biasing spring for the roller 35 is received in the cam chamber together with the roller 35 to press the roller 35 toward a narrow portion of the cam chamber.

The center case 22 is arranged interiorly of the rear end side of the housing .20 and mounted unrotatably with respect to the housing 20. A disk plate 36 for holding the rotation regulating member 7 is mounted on the front surface side of the center case 22 to form a predetermined space relative to the front surface of the center case 22. Further, a cylindrical bearing holding portion 22*a* for holding the bearing 21 is provided integrally in the central portion of the center case 22. The bearing holding portion 22*a* is located between the pinion 6 and the unidirectional clutch.

(Rotation Regulating Member 7)

The rotation regulating member 7 is generally a spring member provided by winding a rod-like metal material about 3/2 turns, whose radially opposite ends are bent-up at right angles to the same axial direction at the diametral opposed position. One bent-up end constitutes a regulating rod 7*a* for regulating the rotation of the pinion 6 by engagement with the engaging groove 27*a* formed on the outer peripheral surface of the rotation regulating plate 27 at the outset of the operation of the starter 1, and the other end 7*b* is engaged with one end of a string member 37 such as a wire forming a connecting member to transmit the operation of the electromagnetic switch 8 through the string-like member 37.

The rotation regulating member 7 is received into a space formed between the center case 22 and the plate 36, and both ends 7*a* and 7*b* thereof are taken out axially forwardly (toward the left side in FIG. 1) from the plate 36 and held vertically (up and down direction in FIG. 1) movably while being regulated in the axial movement by the plate 36. Further, the rotation regulating member 7 is normally biased upward by a return spring not shown, and when the operation of the electromagnetic switch 8 is transmitted to the other end 7*b* through the string member 37, the whole rotation regulating member 7 is moved downward against the spring force of the return spring whereas when the electromagnetic switch 8 is turned off, the whole rotation regulating member 7 is moved upward by the spring force of the return spring and returned to the initial position (position shown in FIG. 1).

(Electromagnetic Switch 8)

The electromagnetic switch 8 is held on an electrically insulating resinous pedestal 38 and pressed into the holder 10 and arranged within the end cover 17, and secured so as to cross in the direction of operation with respect to the armature shaft 4. When a starter switch not shown is turned on and an attraction coil (not shown) encased is energized, the electromagnetic switch 8 attracts a plunger 39 upwardly in the switch 8 by a magnetic force generated by the attraction coil. As a result, electrical contacts (not shown) of the starter motor 3 provided within the switch 8 is closed to energize the armature 2, and drive the rotation regulating member 7 through the string-like member 37.

The string-like member 37 is guided by a roller 40 held on the pedestal 38 and a roller held on a protrusion 41 of the center case 22 to transmit the operation of the plunger 39 to the rotation regulating member 37.

Next, the operation of the present embodiment will be described.

When the starter switch is turned on so that the electromagnetic switch 8 is actuated, the string-like member 37 fixed to the plunger 39 is pulled toward the electromagnetic switch 8 as the plunger 39 moves upward, whereby the rotation regulating member 7 is moved downward along the front surface of the center case 22. As a result, the regulating rod 7*a* of the rotation regulating member 7 comes into engagement with the engaging groove 27*a* of the rotation regulating plate 27 to regulate the rotation of the pinion 6.

On the other hand, the electrical contacts of the starter motor 3 are closed by the electromagnetic switch 8 so that the armature 2 is energized by the electric power supplied through the terminal bolt 18 thereby to generate the rotating force of the armature 2. Thereby, the sun gear 28 rotates together with the armature shaft 4 to rotatively drive the planetary gears 29. At this time, the internal gear 30 meshed with each planetary gear 29 receives the turning force of each planetary gear 29 and tends to rotate in one direction.

By the operation of the internal gear 30, the roller 35 received in the cam chamber of the clutch outer 33 is pressed by the biasing spring and moved toward the narrow portion of the cam chamber into engagement with the outer peripheral surface of the clutch inner member 34. As a result, the clutch outer member 33 is locked by the clutch inner member 34 (unrotatable) formed integrally with the center case 22 through the roller 35 and regulated in rotation. As a result, since the rotation of the internal gear 30 integral with the clutch outer 33 is regulated, the three planetary gears 29 revolve around the outer periphery of the sun gear 8 while rotating about the pin 31, and the revolving force is transmitted to the planet carrier 23 to rotatively drive the output shaft 5.

While the pinion 6 also tends to rotate by the rotation of the output shaft 5, the turning force of the output shaft 5 acts on the pinion 6 as a thrust for extruding it in an axial direction since the pinion 6 is regulated in rotation by the regulating rod 7*a*. As a result, the pinion 6 advances along the helical spline 5*a* with respect to the output shaft 5 until it meshes with the ring gear 24.

When the pinion 6 completely meshes with the ring gear 24, the extreme end (left free end in FIG. 1) of the regulating rod 7*a* is disengaged from the engaging groove 27*a* of the rotation regulating plate 27 and falls onto the rear end side of the rotation regulating plate 27 whereby the rotational regulation to the pinion 6 is released. Thereby, the turning force of the output shaft 5 is transmitted to the ring gear 24 meshed with the pinion 6 to rotate the ring gear 24 so that the engine can start.

As the pinion 6 advances into engagement with the ring gear 24, the biasing force of the spring 25 for biasing the pinion 6 increases. Further, when the pinion 6 is turned by the ring gear 24 after the start of the engine, the turning force of the engine acts in the direction for retreating the pinion 6 by the action of the helical spline 5*a*. The pinion 6 tends to retreat rearwardly along the output shaft 5 by these forces but the free end of the regulating rod 7*a* fallen behind the rear end side of the rotation regulating plate 7 supports the rear end of the rotation regulating plate 27 to impede the withdrawal or rearward retreat of the pinion 6.

Thereafter, when the starter switch is turned off and the operation of the electromagnetic switch 8 stops returning the plunger 39 downward, the force for pulling the rotation regulating member 7 through the string-like member 37 ceases. Therefore, the rotation regulating member 7 is returned upward to the initial position by the force of the return spring. As a result, the regulating rod 7*a* having impeded the withdrawal of the pinion 6 is disengaged from the rotation regulating plate 27, and therefore, the pinion 6 receiving the retreating force from the ring gear 24 is returned to the intial state (the state shown in FIG. 1).

While the partition wall 9*a* is provided integrally with the cylindrical yoke 9, it is to be noted that as a separate member, the partition wall 9*a* may be held between the housing 20 and the yoke 9.

(Effect of the Embodiment)

In the starter 1 according to the present embodiment, the armature shaft 4 and the output shaft 5 are separated axially and arranged in coaxial relation to each other, and the electromagnetic switch 8 is arranged at the rear of the starter motor 3 and fixed so that the operating direction (plunger movement direction) crosses the axial direction of armature shaft 4. Because of this, as compared with a starter having an electromagnetic switch provided radially externally of a starter motor and a starter having an output shaft inserted into an armature shaft, the vibration resistance of the whole body enhances. That is, the electromagnetic switch 8 is arranged at the rear of the starter motor 3 whereby, as opposed to the prior art, the starter motor and the electromagnetic switch 8 are not mounted in a cantilever fashion on the mounting housing to the engine. Therefore, they are not affected each other by the vibrations acting on the heavy members for resonance, and the vibration resistance is better than the starter having the electromagnetic switch provided radially externally of the starter motor 3. Further, since the output shaft 5 is arranged coaxially with the armature shaft 4 forwardly of the armature 2 while being separated axially, the vibrations directly transmitted to the armature shaft 4 from the output shaft 5 can be minimized. Therefore, the vibration resistance is better than the conventional starter having the output shaft inserted into the armature shaft.

Further, since the starter construction is designed so that the armature shaft 4 and the output shaft 5 are supported by the exclusive bearings 14, 15 and 19, 21, respectively, the rigidity of the bearing construction increases, and they are not affected by the vibrations each other. The stable rotation together with the armature shaft 4 and the output shaft 5 can be obtained.

Further, since the bearings 14 and 15 for supporting the armature shaft 4 are held by the frame (the partition wall 9*a* of the yoke 9 and the holder 10) of the starter motor 3, a deviation in radial centers of the bearings 14 and 15 can be eliminated.

In addition, since the starter motor 3 has the face type commutator 16 at the rear end face of the armature 2 with its each commutating surface extending radially, the length of the armature shaft 4 can be shortened as compared with the case where a cylindrical-shaped commutator is provided with its each commutating surface extending axially. The bearings 14 and 15 of the armature shaft 4 are held by the frame whereby the axial spacing therebetween can be made as short as possible. That is, the bearing 14 on the front end side of the shaft 4 is held by the partition wall 9*a* of the yoke 9 arranged close to the front side end of the armature 2 and the bearing 15 on the rear side end of the shaft 4 is held by the holder 10 arranged close to the rear side end of the armature 2 whereby the spacing between the bearings can be made short by effectively making use of the merits by which the length of the armature shaft 4 can be shortened, thus providing a high rigid bearing construction.

Further, the unidirectional clutch is provided behind the bearing 21 supporting the rear end of the output shaft 5 separating from the pinion 6 (it is not provided between a bearing supporting the front end of an output shaft and a bearing supporting the rear end), whereby the axial spacing between the bearings 19 and 21 for the output shaft 5 can be made short to provide a high rigid bearing construction. In addition, since in addition to the starter construction in which the spacing between the bearings can be made short, the unidirectional clutch is not provided between both the bearings 19 and 21, the flexure of the output shaft 5 can be minimized. As a result of the foregoing, the output shaft 5 is suppressed in vibration and can be rotated stably. Further, since the rotation of the output shaft 5 is stable, even when the output shaft 5 is rotated at high speed by the engine after the pinion 6 has been meshed with the ring gear 24, for example, the armature shaft 4 is least affected because the vibration of the output shaft 5 is reduced to a minimum. The vibration of the commutator 16 is suppressed, and the commutation action between the brush 12 and the commutator 16 is not deteriorated.

According to the aforementioned construction, it is possible to realize the starter which is compact, high in rigidity and excellent in vibration resistance and high-speed resistance. Although in case of higher speed reduction ratio (for example, reduction ratio is 8 or more) the rotary speed of the armature increases requiring the enhanced vibration resistance and high-speed resistance, the abovedescribed starter construction will meet such requirements.

The present invention should not be limited to the above-described presently preferred embodiment but may be modified or changed in other constructions without departing from the spirit of the invention.

What is claimed is:

1. A starter for an engine having a ring gear, comprising:

a starter motor having an armature rotating shaft, an armature core secured on the armature rotating shaft, a yoke surrounding the armature core, and a first and a second partition wall members provided on both sides of the yoke;

an output shaft disposed coaxially with the armature rotating shaft and being formed with a spline on an outer periphery thereof;

a pinion having a pinion gear engaged with the spline and adapted to mesh with the ring gear of the engine;

a reduction mechanism for transmitting a rotation of the armature rotating shaft to the output shaft in a reduced speed;

a unidirectional clutch provided in a force transmission path between the output shaft and the starter motor to transmit a turning force from the armature rotating shaft to the output shaft;

a first bearing member for rotatably supporting one end of the output shaft;

a second bearing member for rotatably supporting another end of the output shaft; and a third and a fourth bearing members for rotatably supporting opposite ends of the armature rotating shaft of the starter motor, the third and fourth bearing members being held by the first and second partition wall members of the starter motor respectively.

2. A starter according to claim 1, further comprising:

a housing receiving the pinion therein and supporting the first bearing member; and a center case provided between the pinion and the unidirectional clutch and supporting the second bearing member.

3. A starter according to claim 1, wherein:

the first partition wall member is provided between the armature core of the starter motor and the reduction mechanism.

4. A starter according to claim 3, wherein:

the first partition wall member integrally extends from one end of the yoke of the starter motor to the armature rotating shaft.

5. A starter according to claim 1, further comprising:

a face type commutator provided substantially at right angles to the armature rotating shaft at a side end of the armature core; and a brush supported movably in the second partition wall and held in contact with the the face type commutator.

6. A starter according to claim 1, wherein:

the starter motor includes an armature coil having a coil end protruding from the armature core; and the third bearing member has a part located radially inside the coil end of the armature coil.

7. A starter according to claim 6, wherein:

the part of the third bearing member protrudes into the armature core.

8. A starter according to claim 1, further comprising:

an electromagnetic switch disposed adjacent to the starter motor at a position opposite to the pinion side for controlling energization to the starter motor.

9. A starter for an engine having a ring gear, comprising:

a starter motor having an armature rotating shaft, an armature core secured to the armature rotating shaft, an armature coil wound around the armature core, a field magnetic pole provided radially outside the armature core, and a yoke fixedly supporting the field magnetic pole in an inner periphery thereof;

an output shaft disposed coaxially with the armature rotating shaft and formed with a spline on an outer periphery thereof;

a pinion having a pinion gear engaged with the spline and adapted to mesh with the ring gear of the engine;

reduction mechanism for transmitting a rotation of the armature core to the output shaft in a reduced speed;

a unidirectional clutch provided in a force transmitting path between the output shaft and the starter motor to transmit a turning force from the armature rotating shaft to the output shaft;

a first bearing member for rotatably supporting one end of the output shaft;

a second bearing member for rotatably supporting another end of the output shaft; and a third and a fourth bearing members for rotatably supporting opposite ends of the armature rotating shaft of the starter motor, the third and fourth bearing members being held by the yoke of the starter motor.

10. A starter according to claim 9, wherein:

the starter motor has a face type commutator provided substantially at right angles to the armature rotating shaft at a side end of the armature core, a brush, and a brush holding plate for slidably holding the brush on the face type commutator; and the fourth bearing member for supporting a rear end of the armature rotating shaft is held by the brush holding plate.

11. A starter according to claim 10, wherein:

the armature coil has a coil end protruding axially from the armature core; and the third bearing member has a part located radially inside the coil end of the armature coil.

12. A starter according to claim 11, wherein:

the yoke has a cylindrical portion circumferentially surrounding the armature core, and a side wall plate portion located axially oppositely to the brush holder plate with respect to the armature core and supporting fixedly a front end of the armature rotating shaft.

* * * * *